United States Patent [19]

Karakida et al.

[11] Patent Number: 4,755,444

[45] Date of Patent: Jul. 5, 1988

[54] ELECTROPHOTOGRAPHIC PHOTORECEPTOR

[75] Inventors: Kenichi Karakida; Shigeru Yagi, both of Kanagawa, Japan

[73] Assignee: Fiji Xerox Co., Ltd., Kanagawa, Japan

[21] Appl. No.: 945,541

[22] Filed: Dec. 23, 1986

[30] Foreign Application Priority Data

Dec. 25, 1985 [JP] Japan ..... 60-290869
Dec. 25, 1985 [JP] Japan ..... 60-290870

[51] Int. Cl.[4] ..... G03G 5/14
[52] U.S. Cl. ..... 430/66; 430/67
[58] Field of Search ..... 430/66, 67

[56] References Cited

U.S. PATENT DOCUMENTS 4,634,647 1/1987 Jansen ..... 430/37 X

*Primary Examiner*—J. David Welsh
*Attorney, Agent, or Firm*—Finnegan, Henderson, Farabow, Garrett & Dunner

[57] ABSTRACT

An electrographic photoreceptor comprising a support, an intrinsic silicon photosensitive layer and a surface layer of amophous silicon. To the surface layer is added either hydrogen, germanium, tin or lead in order to use the dangling bonds of the amorphous carbon.

13 Claims, 1 Drawing Sheet

ELECTROPHOTOGRAPHIC PHOTORECEPTOR

BACKGROUND AND FIELD OF THE INVENTION

The present invention relates to an electrophotographic photoreceptor that has a surface layer with improved hardness and which will not produce any blurred image even if it is subjected to cyclic use.

It has recently been proposed that a photoconductive layer made of a silicon-based material (also known as amorphous silicon) be provided on a support to make an electrophotographic photoreceptor. A photoreceptor using a silicon-based photoconductive layer has advantages with respect to mechanical strength, panchromatic color rendition and sensitivity to the long-wavelength light over photoreceptors that employ inorganic photoconductive materials such as Se, tri-Se, ZnO and CdS, or a variety of organic photoconductive materials. However, when a copy obtained with photoreceptor using a silicon-based photoconductive layer is left to stand in air, especially in a hot and humid atmosphere, the image on the copy will become blurred. In addition, when the photoreceptor is rubbed with a drum cleaning blade or a paper stripping finger during the electrophotographic process, the surface state of the photoreceptor is altered to produce an image having surface defects as manifested by white streaks. In order to eliminate these problems, proposals have been made in which surface layers having various compositions such as Si:N, Si:O and Si:C are provided so that the inherent hardness of the silicon-based light-sensitive layer will not be impaired. These surface layers are effective in solving the aforementioned problems.

However, a photoreceptor provided with a surface layer having the above-described compositions such as Si:N, Si:O and Si:C is not suitable for practical use since if it is put to cyclic use over a prolonged period in a hot and humid atmosphere, it becomes more likely to produce a blurred image.

SUMMARY OF THE INVENTION

The present invention has been accomplished in order to eliminate these problems. One object, therefore, of the present invention is to provide an electrophotographic photoreceptor that will not produce any blurred image under any of the operating conditions employed, particularly after cyclic use over a prolonged period in a hot and humid atmosphere.

Another object of the present invention is to provide an electro-photographic photoreceptor having a satisfactory degree of surface hardness.

The aforementioned objects of the present invention can be achieved by an electrophotographic photoreceptor that comprises at least a support, a photosensitive layer and a surface layer. The surface layer is formed of a carbon membrane that is based on carbon and hydrogen or formed of a carbon membrane that is based on carbon and which contains at least one element selected from the group consisting of germanium, tin and lead. Whichever type of the carbon membranes is used, the surface layer in the photoreceptor of the present invention provides a protective layer that has high mechanical strength, good chemical stability and superior optical properties.

DETAILED DESCRIPTION OF THE PREFERRED EMBODIMENTS

The coordination number for bonding of a carbon atom is easily variable to take the value 2, 3 or 4. Because of this nature of the carbon atom, a carbon-based membrane formed by a plasma-assisted CVD technique is likely to contain carbon atoms in the graphite form. A carbonaceous membrane that involves (the bonding) of carbon atoms in a tetrahedral configuration and which displays diamond-like properties such as satisfactory hardness and transparency is attainable under very limited conditions such as in a hot atmosphere. Amorphous carbon that is formed by other techniques such as ion beam sputtering and evaporation are also unsuitable for use as the surface protective layer in an electrophotographic photoreceptor because it contains a larger number of lone pairs in the membrane and is highly likely to contain multiply bound carbon atoms in a graphite form. This results in that the membrane lacks chemical stability as manifested by low resistance to corona discharge and ozone. In addition, the membrane has a strong absorption peak in the visible region and assumes a black color, which is also unsuitable for using the membrane as a protective surface layer.

The present inventors have found that by incorporating hydrogen in an amorphous carbon membrane, the number of lone pairs and multiply bound carbon atoms in a graphite form that are present in the membrane can be reduced. The inventors have also found that if at least one element selected from the group consisting of germanium, tin and lead each having a coordination number of four is incorporated in a small amount in a carbon-based membrane, the bonding of carbon atoms in a tetrahedral configuration is accelerated to achieve a significant increase in the hardness of the membrane. In addition to these facts, the present inventors have found that a surface layer that is based on carbon and which contains at least one element selected from the group consisting of germanium, tin and lead is highly effective. Such a surface layer reduces the chance of a blurred image being produced as a result of the cyclic use in a hot and humid atmosphere of an electrophotographic photoreceptor that employs a silicon-based photosensitive layer. The photoreceptor with this surface layer ensures a sharp image to be copied in all of the circumstances encountered in its operation. The present photoreceptor of the invention has been developed on the basis of these findings.

Figure 4:
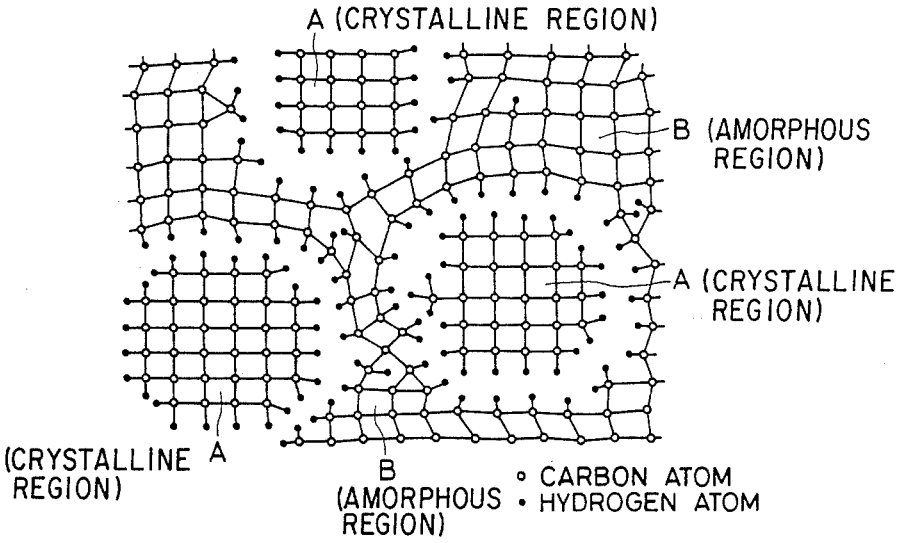
FIG. 4 is a sketch showing a model of a mixed phase of crystalline and amorphous structures.

In accordance with the present invention, the surface layer is based on carbon and hydrogen or the one which is based on carbon and contains at least one element of the group consisting of germanium, tin and lead. Such a surface layer may be crystalline, amorphous or of a mixture of crystalline and amorphous structures. FIG. 4 shows a model of the case where the surface layer is composed of a mixture of crystalline and amorphous structures. As shown, the surface layer having the mixed composition is characterized by crystalline regions A which are surrounded by a chain of hydrogen atoms, which in turn are encircled with an amorphous region B.

The amount in which at least one element selected from the group consisting of germanium, tin and lead is to be incorporated in the surface layer which is based on carbon should be determined in consideration of various factors. This amount is preferably determined in such a manner that a compromise is attained between the following three factors: (1) the range of spectral sensitivity of the light-sensitive layer formed under the surface layer; (2) the hardness of the surface layer; and (3) the efficiency of preventing a blurred image from being produced as a result of cyclic use of the photoreceptor in a hot and humid atmosphere. When germanium, tin or lead is incorporated in a carbon-based surface layer, it starts to develop a color. As the addition of these elements is increased, the hardness of the surface layer is increased but at the same time the absorption of visible light by the surface layer is also increased to thereby narrow the spectral sensitivity range of the underlying photosensitive layer. In other words, the increase in the added amount of germanium, tin or lead contributes to a higher hardness of the surface layer but causes adverse effects on the prevention of a blurred image and the maintanance of a broad spectral sensitivity range. If the amount of these elements added is small, conditions favorable for the purpose of preventing the occurrence of a blurred image and maintaining a broad spectral range of sensitivity are attained. On the other hand, a satisfactory surface hardness is not attainable. Therefore, in order to achieve best compromise between the three factors, i.e., surface hardness, spectral sensitivity range and prevention of a blurred image, at least one element selected from the group consisting of germanium, tin and lead is preferably incorporated in the surface layer in an amount which is not greater than 1, and more preferably not greater than 0.5, atoms of the group per carbon atom.

The above-described surface layer which is based on carbon and which contains at least one element of the group of germanium, tin and lead may optionally contain hydrogen with a view to providing improved electrical properties and enhanced chemical stability.

The electrophotographic photoreceptor of the present invention is hereinafter described in detail with reference to the accompanying drawings.

Figure 1:
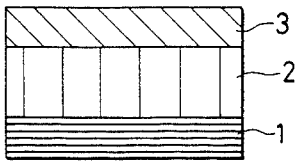
FIG. 1 shows schematically the basic structure of an electrophotographic photoreceptor according to one embodiment of the present invention.

One embodiment of the photoreceptor is shown in FIG. 1 wherein it consists of a support 1, a photosensitive layer 2 and a surface layer 3. The support 1 may be made of an electrically conductive or insulating material. Illustrative materials that can be used to make a conductive support are metals such as aluminum and alloys such as stainless steel. Illustrative examples of an electrically insulating support include films or sheets of synthetic resins such as polyesters, polyethlene, polycarbonates, polystyrene and polyamides, glass, ceramics and paper. If an electrically insulating support 1 is used, at least its surface which is to be contacted with other layers in the photoreceptor must be rendered electrically conductive. This can be achieved by such methods as evaporation, sputtering and lamination which are capable of providing the insulating support with any one of the metals that may be used as conductive supports. The support employed in the present invention may take on any appropriate shape such as a cylinder, a belt or a sheet. The support may have a multi-layered structure. The thickness of the support depends on the type of the specific photoreceptor that is necessary but values of 10 micrometers or more are generally suitable.

The photosensitive layer 2 is preferably formed of a silicon-based material. A silicon-based photosensitive layer may be formed on the support by a variety of methods including glow discharge, sputtering, ion implantation and vacuum evaoporation. While an appropriate method should be selected in accordance with the specific object, the glow discharge method wherein a silane ($SiH_4$) gas is subjected to glow discharge decomposition by a plasma-assisted CVD technique is preferable because this method ensures the formation of a photosensitive layer 2 having characteristics that are suitable for use in electrophotography. Such suitable characteristics are reasonably high levels of hydrogen content in the membrane, a comparatively high dark resistance and high photosensitivity. The formation of a photosensitive layer 2 for use in the photoreceptor of the present invention is hereunder described with reference to the case where it is formed by a plasma-assisted CVD technique.

Starting materials that can be used to form a silicon-based photosensitive layer 2 include silanes, such as silane and disilane, and silicon crystals. A variety of diluting gases such as carrier gases (e.g. hydrogen, helium, argon and neon) may optionally be used. In order to control the dark resistance or charging polarity of the photosensitive layer 2 formed, these gases may be mixed with dopant gases such as a diborane ($B_2H_6$) gas and a phosphine ($PH_3$) gas so that the photoconductive layer being formed is doped with an impurity atom such as boron (B) or phosphorus (P). For the purpose of increasing the dark resistance, light sensitivity or charging ability (i.e., the amount of electricity or charging potential that can be achieved for a unit thickness of the membrane), a suitable atom such as halogen, carbon, oxygen or nitrogen may be incorporated in the photosensitive layer 2. An additional element such as germanium (Ge) may also be incorporated in the photosensitive layer 2 so as to increase the sensitivity to long-wavelength range. It is particularly preferable that the photosensitive layer 2 is an intrinsic semiconductor layer that is silicon-based and which is doped with a minor amount of an element, preferably boron, of group IIIB in the periodic table. A photosensitive layer 2 incorporating the elements listed above may be formed by supplying a plasma-asissted CVD apparatus with a silane gas and the gasified products of substances containing those elements and by then subjecting the mixture to glow discharge decomposition.

The thickness of the silicon-based light-sensitive layer may be set to any desired value but it is preferably set within the range of 1–200 micrometers, more preferably within the range of 5–100 micrometers.

The electrophotographic photoreceptor of the present invention may optionally have another layer formed adjacent to the top or bottom of the silicon-based photosensitive layer 2. Examples of such additional layers include a charge injection blocking layer such as an insulating layer, or a p- or n-type semiconductor layer which is formed by doping amorphous silicon with an element of group III or V of the periodic table. Another addition layer is a sensitizing layer such as a layer formed by doping amorphous silicon with microcrystalline germanium or tin. Yet another additional layer is an adhesive layer formed by doping amorphous silicon with a suitable element such as nitrogen, carbon or oxygen. Further, there may be any other layer that is capable of controlling the electrical or image-associated properties of the photosensitive layer, such as a layer containing both an element of group IIIB of the periodic table and an element of group VB. The thickness of these additional layers may be set to any desired value, which is generally within the range of 0.01 to 10 micrometers.

Figure 2:
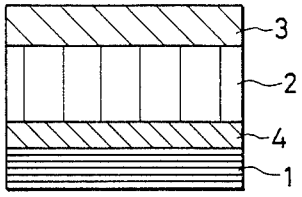
FIGS. 2 and 3 show schematically other embodiments of the photoreceptor of the present invention.
Figure 3:
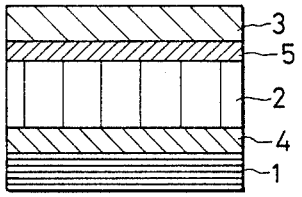

Two embodiments of the case where an additional layer is formed adjacent the photosensitive layer 2 in the photoreceptor of the present invention of the present invention are depicted in FIGS. 2 and 3. In FIG. 2, a charge injection blocking layer 4 is shown to be formed between the photosensitive layer 2 and the support 1. In FIG. 3, in addition to a charge injection blocking layer 4 provided between the sensitive layer 2 and the support 1 there is provided, between the surface layer 3 and the photosensitive layer 2, a layer 5 that contains an element of group IIIB of the periodic table and/or an element of group VB or which has a composition intermediate between the surface layer 3 and the sensitive layer 2 that is atained by mixing their compositions.

The photosensitive layer 2 and the other layers described above may be formed by a plasma-assisted CVD technique. The photosensitive layer 2 doped with the aforementioned impurity elements is formed by supplying a plasma-assisted CVD apparatus with a silane ($SiH_4$) gas and the gasified products of substances containing the appropriate impurity atoms. The mixture is then subjected to glow discharge decomposition. Glow-discharge decomposition by plasma-assisted CVD may effectively be performed under either A.C. or D.C. discharge conditions for the purpose of forming a desirable layer adjacent to the top or bottom of the silicon-based photosensitive layer 2. Typical conditions that may be employed to achieve a.c. glow discharge are: frequency, 0.1–30 MHz (preferably 5–20 MHz); pressure during discharge, 0.1–5 torr ( 1.33 pa–66.7 pa) and substrate temperature, 100°–400° C.

The surface layer 3 which is the heart of the present invention is described hereinafter. First, the surface layer of the type which is based on carbon and hydrogen is explained. If hydrogen, which attains the effects already described, is present in an excessive amount in the membrane, the content of a chain of —$CH_2$— bonds or —$CH_3$ bonds in the membrane is increased to impair the hardness of the surface layer. Therefore, the amount of hydrogen present in the membrane must not be greater than 50 atomic percent i.e., the hydrogen is present in a hydrogen to carbon atomic ratio no greater than 1. The surface layer may be formed in a hydrogen-containing atmosphere by any suitable method such as glow discharge, sputtering, ion implanation or vacuum evaporation. The objects of the present invention are preferably attained by a carbon and hydrogen based surface layer that is formed by decomposing gases or gasified products of hydrocarbon compounds by plasma-assisted CVD. Similarly, the surface layer of the type which is based on carbon and which contains at least one element selected from the group consisting of germanium, tin and lead can be formed by an appropriate method such as glow discharge, sputtering, ion implantation or vacuum evaportion. The objects of the present invention are preferably attained by a carbon-based surface layer that contains elements bound in a tetrahedral configuration and which is formed by decomposing through plasma-assisted CVD gases or gasified products of hydrocarbon compounds together with gases or gasified products of substances containing at least one element selected from the group consisting of germanium, tin and lead.

The following starting materials can be used in forming the surface layer in accordance with the present invention. Carbon materials that provide the basis of the surface layer include: aliphatic hydrocarbons such as paraffinic hydrocarbons represented by the general formula $C_nH_{2n+2}$ (e.g. methane, ethane, propane, butane and pentene), olefinic hydrocarbons represented by the general formula $C_nH_{2n+2}$ (e.g. ethylene, propylene, butylene and pentene), and acetylene-based hydrocarbons represented by the general formula $C_nH_{2n-2}$ (e.g. acetylene, allylene and butyne); alicyclic hydrocarbons such as cyclopropane, cyclobutane, cyclopentane, cyclohexane, cycloheptane, cyclobutene, cyclopentane and cyclohexene; aromatic compounds such as benzene, toluene, xylene, naphthalene and anthracene; and organic substituted products thereof. These starting compounds may be branched or substituted with halogens, as in the case of halogenated hydrocarbons such as carbon tetrachloride, chloroform, carbon tetrafluoride, trifluoromethane, chlorotrifluoromethane, dichlorodifluoromethane, bromotrifluoromethane, perfluoroethane, and perfluoropropane.

Illustrative starting materials that contain germanium include germane, digermane and trigermane. Tin-containing starting materials include stannane, stanic chloride, tetramethyltin an tetraethyltin. Lead-containing starting materials include plumbane and tetramethyllead.

The above-listed starting materials which provide the basis of the surface layer and the starting materials for incorporating germanium, tin or lead into that layer may be gaseous, solid or liquid at ordinary temperatures, and are used after being evaporated if they are solid or liquid at ordinary temperatures. At least one gaseous starting material selected from the group of the compounds listed above is supplied into an evacuated vessel, in which glow discharge is allowed to occur to form a surface layer on the photosensitive layer that is made of carbon- and hydrogen-based amorphous carbon. If necessary, a third gaseous substance that is dissimilar to the gaseous starting materials shown above may be employed. Illustrative third gaseous substances are carrier gases such as hydrogen, helium, argon and neon. With a view to increasing the resistance of the surface layer and to improving other characteristics thereof, it may be doped with an impurity element such as boron or phosphorus by employing gaseous or gasifilable substances containing elements of group III or V of the periodic table. These gaseous or gasifiable substances are exemplified by, for example, boron compounds such as diborane, boron trifluoride and boron trichloride, or phosphorus compounds such as phosphine, diphosphine, phosphorus pentafluoride, phosphorus trichloride and phosphorus pentachloride. The surface layer may have photoconductivity. If desired, the surface layer that is based on carbon and which contains at least one element selected from the group consisting of germanium, tin and lead may also contain hydrogen.

Either A.C. or D.C. conditions may be employed to perform glow discharge decomposition of the starting materials described above during plasma-assisted CVD. Typical conditions that may be used to form a membrane are: frequency, 0–30 MHz (preferably 5–20

MHz); pressure during discharge, 0.1–5 torr (1.33 pa–66.7 pa); and substrate temperature, 100°–400° C. The thickness of the surface substrate being formed may be set to any desired value, which generally ranges from 0.01 to 10 micrometers, preferably from 0.2 to 5 micrometers.

The foregoing description concerns the case where the surface layer of the present invention is provided for a photoreceptor having a silicon-based photosensitive layer. The surface layer may be provided for other types of photoreceptor such as one having an inorganic photoconductive layer in the form of an evaporated Se or tri-Se layer or a resin-bound CdS or ZnO layer. Another type of photoreceptor is an organic type that typically uses a dual-layered photosensitiver system composed of a charge generation layer having a charge generating material dispersed in a binder resin and a charge transport layer having a charge transporting material dispersed in a binder resin. In either case, the surface layer formed in accordance with the present invention has a satisfactory level of hardness.

The electrophotographic photoreceptor of the present invention employs a surface layer that is formed of amorphous carbon which is based on hydrogen and carbon or amorphous carbon which is based on carbon and contains at least one element selected from the group consisting of germanium, tin and lead. The surface layer formed of such amorphous carbon has a very high level of surface hardness so that the photoreceptor of the present invention is effectively protected against surface damage that will otherwise occur during the electrophotographic process because of contact with devices such as the drum cleaning blade and paper stripping finger. In addition, the photoreceptor will not cause any blurred image under any of the operating conditions that may be encountered during processing. The commercial advantage of this photoreceptor is particularly high as manifested by the absence of any blurred image or low image density even if it is subjected to cyclic use in a hot and humid atmosphere.

The following examples are provided for the purpose of further illustrating the present invention but are in no way to be taken as limiting.

EXAMPLE 1

The equipment used in this example was a parallel-plate plasma-assisted CVD apparatus capable of forming an amorphous silicon film on a cylindrical substrate. In this apparatus, a mixture of silane ($SiH_4$) and diborane ($B_2H_6$) gases was subjected to glow discharge decomposition to form a p-type amorphous silicon layer (0.2 micrometers thick and containing 5 ppm of boron) on the cylindrical aluminum substrate. Then an intrinsic amorphous silicon layer having a thickness of 20 micrometers and containing 5 ppm of boron was formed to provide a photosensitive layer. Subsequently, the apparatus was evacuated and continuously fed with methane ($CH_4$) and hydrogen gases at respective flow rates of 200 ml/min and 100 ml/min, while glow discharge was allowed to take place in the reactor at a controlled internal pressure of 1.0 torr, so as to form a surface layer 0.5 micrometers thick that was based on amorphous carbon and which contained hydrogen.

The surface layer thus formed was found to have a hydrogen content of 25 at .% by IR absorption analysis. In addition, the surface layer was very hard (Vickers hardness, 1,200 kg/cm$^2$).

The photoreceptor prepared in this example was set in an electrophotographic copier and processed by a positive corona charging method and under two different conditions (35° C.×85% r.h. and 5° C.×15% r.h.). Copying process was repeated more than 50,000 times to evaluate the quality of the images obtained. Neither a blurred image nor images with lowered density were detected in all copies obtained. The photoreceptor did not have any surface defect due to abrasive contact with the drum cleaning blade or paper stripping finger.

EXAMPLE 2

A photosensitive layer was formed on a cylindrical aluminum substrate as in Example 1. Subsequently, the equipment was evacuated and continuously fed with ethylene ($C_2H_4$) and hydrogen gases at equal flow rates of 100 ml/min while glow discharge was allowed to take place in the reactor at a controlled internal pressure of 0.5 torr. This process formed a surface layer 0.5 micrometers thick that was based on amorphous carbon and which contained hydrogen.

The surface layer thus formed was found to have a hydrogen content of 30 at .% by IR absorption analysis. In addition, the surface layer was very hard (Vickers hardness, 650 kg/cm$^2$).

The photoreceptor prepared in this example was subjected to the evaluation of image quality as in Example 1. Even after 50,000 copies were obtained, neither a blurred image nor reduction in image density had taken place. The photoreceptor did not have any surface defect due to abrasive contact with the drum cleaning blade or paper stripping finger.

EXAMPLE 3

A photosensitive layer was formed on a cylindrical aluminum substrate as in Example 1. Subsequently, the equipment was evacuated and continuously fed with carbon tetrafluoride ($CF_4$) and hydrogen gases at equal flow rates of 100 ml/min while glow discharge was allowed to take place in the reactor at a controlled internal pressure of 0.5 torr. A surface layer 0.5 micrometers thick was formed that was based on amorphous carbon and which contained hydrogen.

The surface layer thus formed was found to have a hydrogen content of 30 at .% by IR absorption analysis. In addition, the surface layer was very hard (Vickers hardness, 500 kg/cm$^2$).

The photoreceptor prepared in this example was subjected to the evaluation of image quality as in Example 1. Even after 50,000 copies were obtained, neither a blurred image nor reduction in image density had taken place. The photoreceptor did not have any surface defect due to abrasive contact with the drum cleaning blade or paper stripping finger.

EXAMPLE 4

A photosensitive layer was formed on a cylindrical aluminum substrate as in Example 1. Subsequently, the equipment was evacuated and continuously fed with carbon tetrafluoride ($CF_4$) and methane ($CH_4$) gases at equal flow rates of 100 ml/min while glow discharge was allowed to take place in the reactor at a controlled internal pressure of 0.5 torr. A surface layer 0.5 micrometer thick was formed that was based on amorphous carbon and which contained hydrogen.

The surface layer thus formed was found to have a hydrogen content of 30 at .% by IR absorption analysis.

In addition, the surface layer was very hard (Vickers hardness, 800 kg/cm$^2$).

The photoreceptor prepared in this example was subjected to the evaluation of image quality as in Example 1. Even after 50,000 copies were obtained, neither a blurred image nor reduction in image density had taken place. The photoreceptor did not have any surface defect due to abrasive contact with the drum cleaning blade or paper stripping finger.

EXAMPLE 5

The equipment used in this example was a parallel-plate plasma-assisted CVD apparatus capable of forming an amorphous silicon film on a cylindrical substrate. In this apparatus, a mixture of silane ($SiH_4$) and diborane ($B_2H_6$) gases was subjected to glow discharge decomposition to form a p-type amorphous silicon layer (0.2 micrometers thick and containing 200 pm of boron) on the cylindrical aluminum substate. Then, an intrinsic amorphous silicon layer having a thickness of 20 micrometers and containing 5 ppm of boron was formed to provide a photosensitive layer.

Subsequently, the apparatus was evacuated and continuously fed with methane ($CH_4$) and germane ($GeH_4$) gases at respective flow rates of 200 ml/min and 5 ml/min, while glow discharge was allowed to take place in the reactor at a controlled internal pressure of 1.0 torr. A surface layer 0.5 micrometer thick was formed that was based on amorphous carbon and which contained germanium.

Analysis by X-ray photoelectron spectroscopy showed that the surface layer thus formed and the composition $C_{5.5}Ge_{1.0}$. In addition, the surface layer was very hard (Vickers hardness, 1,200 kg/cm$^2$).

The photoreceptor prepared in this example was set in an electrophotographic copier and processed by a positive corona charging method under two different conditions (35° C.×85% r.h. (relative humidity) and 5° C.×15% r.h.). Copying process was repeated more than 50,000 times to evaluate the quality of the images obtained. Neither a blurred image nor images with lowered density were detected in all copies obtained. The photoreceptor did not have any surface defect due to abrasive contact with the drum cleaning blade or paper stripping finger.

Example 6

A photosensitive layer was formed on a cylindrical aluminum substrate as in Example 5. Subsequently, the equipment was evacuated and continuously fed with methane ($CH_4$) and tetramethyl germane [$(CH_3)$ Ge] at respective flow rates of 100 ml/min and 10 ml/min while glow discharge was allowed to take place in the reactor at a controlled internal pressure of 1.0 torr. A surface layer 0.5 micrometers thick was formed that was based on amorphous carbon and which contained germanium.

Analysis by X-ray photoelectron spectroscopy showed that the surface layer thus formed had the composition $C_{10}Ge_1$. In addition, the surface layer was very hard (Vickers hardness, 1,100 kg/cm$^2$).

The photoreceptor prepared in this example was subjected to the evaluation of image quality as in Example 5. Even after 50,000 copies were obtained, neither a blurred image nor reduction in image density had taken place. The photoreceptor did not have any surface defect due to abrasive contact with the drum cleaning blade or paper stripping finger.

EXAMPLE 7

A photosensitive layer was formed on a cylindrical aluminum substrate as in Example 5. Subsequently, the equipment was evacuated and continuously fed with methane ($CH_4$) and stannane ($SnH_4$) gases at respective flow rates of 200 ml/min and 5 ml/min while glow discharge was allowed to take place in ther reactor at a controlled internal pressure of 1.0 torr. A surface layer 0.5 micrometer thick was formed that was based on amorphous carbon and which contained tin.

Analysis by X-ray photoelectron spectroscopy showed that the surface layer thus formed had the composition $C_{4.0}Sn_{1.0}$. In addition, the surface layer was very hard (Vickers hardness, 1,200 kg/cm$^2$).

EXAMPLE 8

A photosensitive layer was formed on a cylindrical aluminum substrate as in Example 5. Subsequently, the equipment was evacuated and continuously fed with ethane ($C_2H_6$) and plumbane ($PbH_4$) gases at respective flow rates of 100 ml/min and 10 ml/min while glow discharge was allowed to take place in the reactor at a controlled internal pressure of 1.0 torr. A surface layer 0.2 micrometers thick was formed that was based on amorphous carbon and which contained lead. This surface layer was very hard (Vickers hardness, 1,000 kg/cm$^2$).

The photoreceptor prepared in this example was subjected to the evaluation of image quality as in Example 5. Even after 50,000 copies were obtained, neither a blurred image nor reduction in image density had taken place. The photoreceptor did not have a surface defect due to abrasive contact with the drum cleaning blade or paper stripping finger.

What is claimed is:

1. An electrographic photoreceptor, comprising:

a support;

a photosensitive layer formed on said support; and an amorphous carbon surface layer formed by decomposition of a mixed gas comprising a hydrogen-containing gas and a second gas selected from the group consisting of hydrocarbon compounds and halogenated hydrocarbons on said photosensitive layer, said amorphous carbon surface layer comprising carbon atoms and hydrogen atoms in a hydrogen to carbon atomic ratio no greater than 1.

2. A photoreceptor as recited in claim 1, wherein said amorphous carbon surface layer further comprising a predetermined amount of at least one element selected from the group consisting of germanium, tin and lead.

3. A photoreceptor as recited in claim 1, wherein said amorphous carbon surface layer comprises carbon atoms and hydrogen atoms in a hydrogen to carbon atomic ratio no greater than 0.5.

4. A photoreceptor as recited in claim 1, wherein said photosensitive layer is a silicon layer.

5. A photoreceptor as recited in claim 4, wherein said silicon layer is an intrinsic semiconductor layer.

6. A photoreceptor as recited in claim 2, wherein said element selected from the group consisting of germanium, tin, and lead is present in an atomic ratio no greater than 0.5 with respect to carbon.

7. A photoreceptor as recited in claim 2, wherein said photosensitive layer is a silicon layer.

8. A photoreceptor as recited in claim 2, wherein said silicon layer is an intrinsic semiconductor layer.

9. An electrographic photoreceptor comprising:

a support;

a photosensitive layer formed on said support; and an amorphous carbon surface layer formed by decomposition of a mixed gas comprising a first gas selected from the group consisting of hydrocarbons and halogenated hydrocarbons, and a second gas containing at least one element selected from the group consisting of germanium, tin, and lead, said amorphous carbon surface layer comprising carbon atoms, atoms of at least one element selected from the group consisting of germanium, tin, and lead, and hydrogen atoms, wherein said hydrogen is present in a hydrogen to carbon atomic ratio no greater than 1.

10. An electrographic photoreceptor comprising:

a support;

a photosensitive layer formed on said support; and an amorphous carbon surface layer formed on said photosensitive layer, said surface layer comprising carbon atoms and atoms of at least one element selected from the group consisting of germanium, tin, and lead, present in an atomic ratio no greater than 1 with respect to carbon.

11. A photoreceptor as recited in claim 1, wherein said second gas is methane, ethylene, or carbon tetrafluoride.

12. A photoreceptor as recited in claim 9, wherein said first gas is methane or ethane and said second gas is germane, tetramethyl germane, stannane, or plumbane.

13. A photoreceptor as recited in claim 1, wherein said surface layer has a hydrogen content not greater than 30 atomic percent.

* * * * *